US012612571B2

(12) United States Patent
Brampton et al.

(10) Patent No.: US 12,612,571 B2
(45) Date of Patent: Apr. 28, 2026

(54) DIESEL FUEL AND FUEL ADDITIVE WITH A COMBUSTION CATALYST

(71) Applicant: CDTi Advanced Materials, Inc., Oxnard, CA (US)

(72) Inventors: Toby William Brampton, Crawley (GB); Edward J. Lee, Ventura, CA (US); Ru-Fen Liu, Port Hueneme, CA (US); Campbell McConnell, Ventura, CA (US)

(73) Assignee: CDTI Advanced Material, Inc., Oxnard, CA (US)

( * ) Notice: Subject to any disclaimer, the term of this patent is extended or adjusted under 35 U.S.C. 154(b) by 0 days.

(21) Appl. No.: 18/324,652

(22) Filed: May 26, 2023

(65) Prior Publication Data

US 2024/0166964 A1 May 23, 2024

Related U.S. Application Data

(63) Continuation of application No. PCT/US2022/078239, filed on Oct. 17, 2022.

(Continued)

(51) Int. Cl.
*C10L 1/30* (2006.01)
*C10L 1/08* (2006.01)

(Continued)

(52) U.S. Cl.
CPC ..... *C10L 1/305* (2013.01); *C10L 1/08* (2013.01); *C10L 1/106* (2013.01); *C10L 1/1233* (2013.01); *C10L 1/1616* (2013.01); *C10L 1/1811* (2013.01); *C10L 1/231* (2013.01); *C10L 10/08* (2013.01); *C10L 10/12* (2013.01); *C10L 10/18* (2013.01);

(Continued)

(58) Field of Classification Search
CPC .. C10L 1/305; C10L 1/08; C10L 1/106; C10L 1/1233; C10L 1/1616; C10L 1/1811; C10L 1/231; C10L 10/08; C10L 10/12; C10L 10/18; C10L 2200/04; C10L 2300/20; C10L 2300/30; C10L 1/1608; C10L 1/1881; C10L 2200/0213;

(Continued)

(56) References Cited

U.S. PATENT DOCUMENTS 7,901,472 B2 3/2011 Perry
8,591,725 B2 11/2013 Sundaram et al.

(Continued)

FOREIGN PATENT DOCUMENTS

CN 109207212 A 1/2019
EP 0189642 A1 8/1986

(Continued)

OTHER PUBLICATIONS

Written Opinion of the International searching Authority for International Application No. PCT/US2022/078239 dated Jan. 6, 2023.

(Continued)

*Primary Examiner* — Cephia D Toomer
(74) *Attorney, Agent, or Firm* — Launchpad IP, Inc.; Christopher A. Wiklof

(57) ABSTRACT

A diesel fuel additive includes a cetane number improver and an at least one organometallic combustion catalyst in solution and/or at least one metal-oxide combustion catalyst in suspension.

18 Claims, 3 Drawing Sheets

Related U.S. Application Data

(60) Provisional application No. 63/256,166, filed on Oct. 15, 2021.

(51) Int. Cl.

| | |
|---|---|
| ***C10L 1/10*** | (2006.01) |
| ***C10L 1/12*** | (2006.01) |
| ***C10L 1/16*** | (2006.01) |
| ***C10L 1/18*** | (2006.01) |
| ***C10L 1/23*** | (2006.01) |
| ***C10L 10/08*** | (2006.01) |
| ***C10L 10/12*** | (2006.01) |
| ***C10L 10/18*** | (2006.01) |

(52) U.S. Cl.
CPC ..... *C10L 2200/04* (2013.01); *C10L 2300/20* (2013.01); *C10L 2300/30* (2013.01)

(58) Field of Classification Search
CPC ..... C10L 2200/0236; C10L 2200/024; C10L 2200/0245; C10L 2270/026; C10L 1/10
See application file for complete search history.

(56) References Cited

U.S. PATENT DOCUMENTS

| | | | | |
|---|---|---|---|---|
| 9,771,534 | B2 | 9/2017 | Sprague et al. | |
| 2004/0031192 | A1 | 2/2004 | Pedrazzini | |
| 2005/0060929 | A1* | 3/2005 | Caprotti | C10L 10/06 44/354 |
| 2006/0254535 | A1 | 11/2006 | Valentine et al. | |
| 2007/0015656 | A1* | 1/2007 | Valentine | F02M 27/02 502/325 |
| 2007/0234637 | A1 | 10/2007 | Stark et al. | |
| 2007/0277431 | A1 | 12/2007 | Ohno et al. | |
| 2008/0098644 | A1 | 5/2008 | Roos et al. | |
| 2009/0013588 | A1 | 1/2009 | Zhou et al. | |
| 2009/0056203 | A1 | 3/2009 | Schield et al. | |
| 2009/0056207 | A1 | 3/2009 | Perry | |
| 2015/0210947 | A1 | 7/2015 | Parson et al. | |
| 2020/0095512 | A1 | 3/2020 | Remondini et al. | |

FOREIGN PATENT DOCUMENTS

| | | | |
|---|---|---|---|
| EP | 1856383 | B1 | 10/2012 |
| WO | 97/04045 | A1 | 2/1997 |
| WO | 01/85876 | A1 | 11/2001 |
| WO | 2006/078763 | A3 | 7/2006 |

OTHER PUBLICATIONS

International Search Report for International Patent No. PCT/US2022/078239 dated Jan. 6, 2023.

* cited by examiner

DIESEL FUEL AND FUEL ADDITIVE WITH A COMBUSTION CATALYST

CROSS REFERENCE TO RELATED APPLICATIONS

The present application is a Continuation which claims priority benefit under 35 U.S.C. from § 120 (pre-AIA) of co-pending International Patent Application No. PCT/US2022/78239, entitled "DIESEL FUEL AND FUEL ADDITIVE WITH A COMBUSTION CATALYST," filed Oct. 17, 2022, currently pending; which claims priority from U.S. Provisional Patent Application No. 63/256,166, entitled "FUEL ADDITIVE WITH FUEL-BORNE CATALYST AND FUEL WITH FUEL-BORNE CATALYST," filed Oct. 15, 2021. Each of the foregoing applications, to the extent not inconsistent with the disclosure herein, is incorporated by reference.

SUMMARY

According to an embodiment, a diesel fuel additive includes one or more hydrocarbon solvents predominantly including carbon numbers between C6 and C16 at less than 65% concentration by weight, a cetane number improver (soluble in or miscible with the one or more hydrocarbon solvents) at 20% to 85% concentration by weight, and at least one organometallic combustion catalyst. The organometallic combustion catalyst(s) including a positive oxidation state metal ion in a coordination complex providing solubility in the one or more hydrocarbon solvents, the at least one organometallic combustion catalyst being at 0.1% to 30% total concentration by weight.

According to an embodiment, a fuel additive includes an aromatic hydrocarbon solvent at a concentration of between 15% and 40% by weight, a combustion catalyst including a positive oxidation state metal ion disposed in a coordination complex between two organic rings and dissolved in the aromatic hydrocarbon solvent, and a cetane number improver at a concentration of 20% to 80% by weight.

According to an embodiment, a diesel fuel additive includes a cetane number improver including at least one of the group consisting of a nitro-substituted organic, a nitro carbonate, and an organic peroxide; and a combustion catalyst including a metal oxide suspended in a solvent, the metal oxide including magnesium (Mg), potassium (K), calcium (Ca), manganese (Mn), iron (Fe), and/or cerium (Ce).

According to embodiments, a diesel fuel includes a diesel fuel additive described above. The diesel fuel additive is diluted by the fuel to produce the cetane number improver at a concentration in the fuel of between fifty and two thousand parts per million (50-2000 ppm) and the at least one organometallic combustion catalyst at a concentration in the fuel of between one and one-hundred parts per million (1-100 ppm).

DETAILED DESCRIPTION

Figure 2:
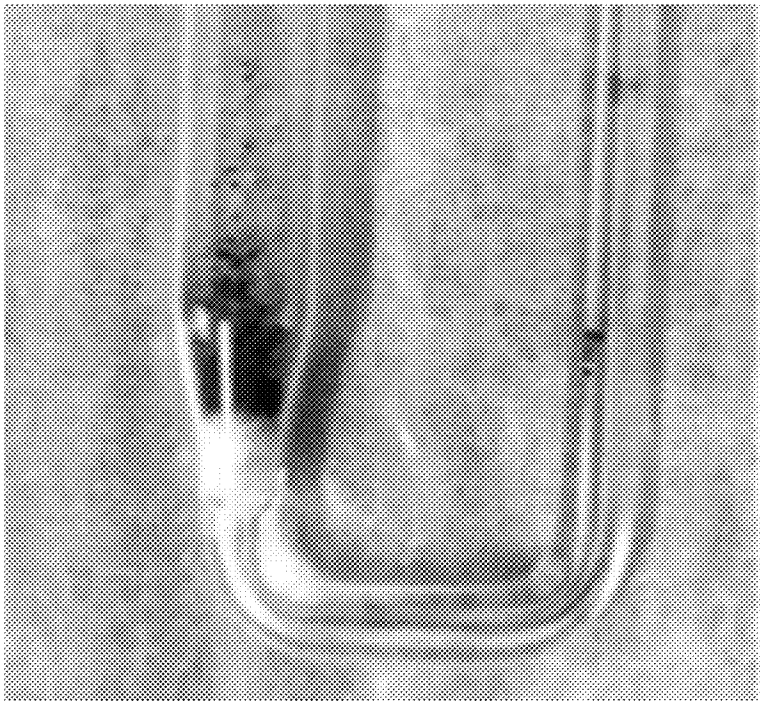
FIG. 2 is a photo showing a temperature programmed oxidation reactor following programmed heating of a test sample B including a metal oxide combustion catalyst and soot, according to an embodiment.

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure.

According to an embodiment, a diesel fuel additive includes one or more hydrocarbon solvents predominantly including carbon numbers between C6 and C16 at less than 65% concentration by weight, a cetane number improver, soluble in or miscible with the one or more hydrocarbon solvents, at 20% to 85% concentration by weight, and at least one organometallic combustion catalyst including a positive oxidation state metal ion in a coordination complex providing solubility in the one or more hydrocarbon solvents, the at least one organometallic combustion catalyst being at 0.1% to 30% total concentration by weight. According to alternate embodiments, the one or more hydrocarbon solvents may be at less than 56% concentration by weight, in one embodiment, or less than 39% concentration by weight, in another embodiment.

The range of 0.1% to 30% concentration by weight, of the at least one organometallic combustion catalyst refers to the total weight of the metal+organic components of the coordination complex. For embodiments including more than one metal, the concentration range refers to the sum of all metals and their respective coordination complexes.

According to an embodiment, the one or more hydrocarbon solvents and the at least one organometallic combustion catalyst are collectively less than 70% concentration by weight.

The organic components of the diesel fuel additive may be limited to molecules having carbon numbers of C19 or less. The diesel fuel additive may optionally be characterized such that at least 90% of organic molecules in the diesel fuel additive have carbon numbers of C6 to C16.

The one or more hydrocarbon solvents predominantly including carbon numbers between C6 and C16 may be at a concentration between 10% and 45% by weight.

The one or more hydrocarbon solvents may include hydrotreated heavy petroleum naphtha, predominantly having carbon numbers between C6 and C13 at 0.5% to 25% concentration by weight, light aromatic petroleum solvent naphtha having carbon numbers between C9 and C16 at a concentration between 1.5% and 40% by weight, and heavy aromatic petroleum solvent naphtha having carbon numbers between C8 and C10 at a concentration between 2% and 25% by weight, such that the sum of the hydrotreated heavy petroleum naphtha, light aromatic petroleum solvent naphtha, and heavy aromatic petroleum solvent naphtha is less than 65% by weight. The one or more hydrocarbon solvents may be limited to one or more aromatic solvents. For example, the one or more hydrocarbon solvents may include benzene, toluene, ethylbenzene, solvent naphtha, naphthalene, 1,2,4-trimethylbenzene, solvent 100, solvent 150, and/or solvent 200.

The cetane number improver may be at 40-80% concentration by weight. In some embodiments, the cetane number improver is at 40% to 70% concentration by weight. The cetane number improver may includes a nitro-substituted organic molecule ($R—NO_2$) having a carbon number between C6 and C19, a nitro-alkane, 2-ethylhexylnitrate, a nitro carbonate organic molecule having a carbon number between C6 and C19, and/or a peroxide organic molecule having a carbon number between C6 and C19.

The at least one organometallic combustion catalyst may have a concentration of 1% to 20% by weight. For example, the organometallic combustion catalyst(s) may have a total concentration of 1.3% to 17% by weight.

The at least one positive oxidation state metal ion in a coordination complex may include at least one of a metal stearate, a metal oleate, a metal octoate, a metal neodecanoate, a metal enoate, a metal diphenyl(1,5 cyclooctadiene), which may also be referred to as COD), a metal acetylacetonate (which may also be referred to as ACAC), and/or a metal dichloro(ethylenediamine).

In an embodiment, the diesel fuel additive also includes a combustion catalyst including a metal oxide in suspension. The metal oxide may include cerium dioxide.

According to an embodiment, the at least one positive oxidation state metal ion includes a positive oxidation state metal ion and one or more ligands ionically bound to the positive oxidation state metal ion. The positive oxidation state metal ion may include one or more of magnesium (Mg), potassium (K), calcium (Ca), manganese (Mn), iron (Fe), cerium (Ce), and/or platinum (Pt).

According to a further embodiment, the at least one positive oxidation state metal ion may include, in respective coordination complexes, two or more different positive oxidation state metal ions. In an embodiment, the two or more different positive oxidation state metal ions are cerium and iron. The respective coordination complexes may include a cerium and ligand complex at a concentration of between 0.1% and 9% by weight and an iron and ligand complex at a concentration of between 0.75% and 28% by weight.

In another embodiment, the two or more different positive oxidation state metal ions may include cerium and platinum. According to a further embodiment, the two or more different positive oxidation state metal ions may include a coordination complex that includes a cerium and ligand complex at a concentration of between 0.5% and 15% by weight and a platinum and ligand complex at a concentration of between 0.001% and 0.1% by weight.

According to an embodiment, the least one organometallic combustion catalyst may be limited essentially to a single organometallic combustion catalyst. According to other embodiments, the organometallic combustion catalyst may be a cerium and ligand complex at a concentration of between 3% and 20% by weight, or an iron and ligand complex at a concentration of 7.5% to 28% by weight.

According to embodiments, the diesel fuel additive includes a detergent soluble in the one or more hydrocarbon solvents. The diesel fuel additive may also include a lubricant soluble in the one or more hydrocarbon solvents, the lubricant including an acid- or ester-functionalized aliphatic chain.

The diesel fuel additive may include less than 1% concentration by weight alcohol. For example, the diesel fuel additive may include less than 0.5% concentration by weight 2-ethyl-1-hexanol. Alternatively, the diesel fuel additive may include less than 5% concentration by weight 2-ethyl-1-hexanol. In an embodiment, the diesel fuel additive includes less than 0.5% concentration by weight alcohol.

According to embodiments, with reference to the one or more hydrocarbon solvents, the hydrotreated heavy petroleum naphtha may be, e.g., naphtha (petroleum) hydrotreated heavy (CAS no. 64742-48-9). The light aromatic petroleum solvent naphtha may be, e.g., solvent naphtha, petroleum, light aromatic (CAS no. 64742-95-6). The heavy aromatic petroleum solvent naphtha may be, e.g., solvent naphtha, petroleum, heavy aromatic (CAS no. 647-94-5).

According to an embodiment, a fuel additive includes an aromatic hydrocarbon solvent at a concentration of between 15% and 40% by weight, a combustion catalyst including a positive oxidation state metal ion disposed in a coordination complex between two organic rings and dissolved in the aromatic hydrocarbon solvent, and a cetane number improver at a concentration of 20% to 80% by weight. A positive oxidation state metal ion disposed in a coordination complex between two organic rings is sometimes referred to as a sandwich compound.

According to an embodiment, the cetane number improver may be at 40-80% concentration by weight. According to a further embodiment, the cetane number improver may be at 40% to 70% concentration by weight.

In one embodiment, the cetane number improver may include one or more of a nitro-substituted organic molecule having a carbon number between C6 and C19, a nitro-alkane, 2-ethylhexylnitrate, a nitro carbonate organic molecule having a carbon number between C6 and C19, and/or a peroxide organic molecule having a carbon number between C6 and C19. According to an embodiment, the cetane number improver may be limited essentially to one cetane number improver.

According to an embodiment, the combustion catalyst may be at a concentration of between 0.75% and 10% by weight. According to a further embodiment, the combustion catalyst may be at a concentration of between 1.5% and 7.5% by weight. According to an embodiment, the positive oxidation state metal ion is between 0.25% and 3% concentration by weight.

In some embodiments, the combustion catalyst includes two or more different positive oxidation state metals. For example, the two or more different positive oxidation state metal ions may include a first metal ion in a metalocene and a platinum ion stabilized by a ligand. For example, the platinum ion may consist essentially of one or more of diphenyl(1,5-cyclooctadiene) Pt II (which may also be referred to as PtCOD), acetylacetonate Pt II (which may also be referred to as PtACAC), and/or dichloro(ethylenediamine) Pt II. The platinum ion may be at a concentration of between 0.001% and 0.1%.

In other embodiments, the catalyst includes one positive oxidation state metal.

According to an embodiment, the positive oxidation state metal ion disposed in the coordination complex between the two organic rings is a metalocene. The positive oxidation state metal ion may include one or more of magnesium (Mg), potassium (K), calcium (Ca), manganese (Mn), iron (Fe), and/or cerium (Ce). For example, the metalocene comprises ferrocene. According to other embodiments, the metalocene does not include ferrocene. For example, the metallocene may include cerium disposed between two 5-member carbon rings in a coordination complex. According to an embodiment, the combustion catalyst may be prepared by dissolving the metalocene in at least a portion of the aromatic hydrocarbon solvent.

According to an embodiment, the aromatic hydrocarbon solvent may include one or more of benzene, toluene, ethylbenzene, solvent naphtha, naphthalene, 1,2,4-trimethylbenzene, solvent 100, solvent 150, and/or solvent 200. According to one embodiment, the aromatic hydrocarbon solvent may consist essentially of solvent 150.

According to an embodiment, the fuel additive may further include a detergent soluble in the aromatic hydrocarbon solvent.

According to an embodiment, the fuel additive may further include a lubricant soluble in the aromatic hydrocarbon solvents, which may itself include an acid- or ester-functionalized aliphatic chain. The lubricant additionally or alternatively include a partially unsaturated aliphatic chain having a carbon number between C6 and C19 According to an embodiment, the fuel additive may include an aliphatic hydrocarbon solvent at a concentration of less than 2%.

According to an embodiment, a diesel fuel additive includes a cetane number improver such as a nitro (—$NO_2$)-substituted organic, a nitro carbonate, and/or an organic peroxide. The diesel fuel additive also includes a combustion catalyst provided as a metal oxide suspended in a solvent. The metal oxide may include an oxide of one or more metals, including magnesium (Mg), potassium (K), calcium (Ca), manganese (Mn), iron (Fe), and/or cerium (Ce).

The solvent may include one or more hydrocarbon solvents predominantly including carbon numbers between C6 and C16 at less than 75% concentration by weight.

According to embodiments, the one or more hydrocarbon solvents may include benzene, toluene, ethylbenzene, solvent naphtha, naphthalene, 1,2,4-trimethylbenzene, solvent 100, solvent 150, and/or solvent 200.

According to an embodiment, the metal in the metal oxide is at between 0.05% and 15% concentration by weight. According to another embodiment, the metal may consist essentially of cerium, which may be at a concentration of between 0.2% and 4% by weight.

According to an embodiment, the diesel fuel additive may further comprise an aromatic hydrocarbon solvent, a detergent soluble in the aromatic hydrocarbon solvent, and a lubricant soluble in the solvent, the lubricant including an acid- or ester-functionalized aliphatic chain.

In experiments, combustion catalyst samples described and claimed herein, including organometallic samples and metal oxide samples, were tested in temperature programmed oxidation reactors to provide performance comparisons against a control sample including no catalyst.

Figure 1:
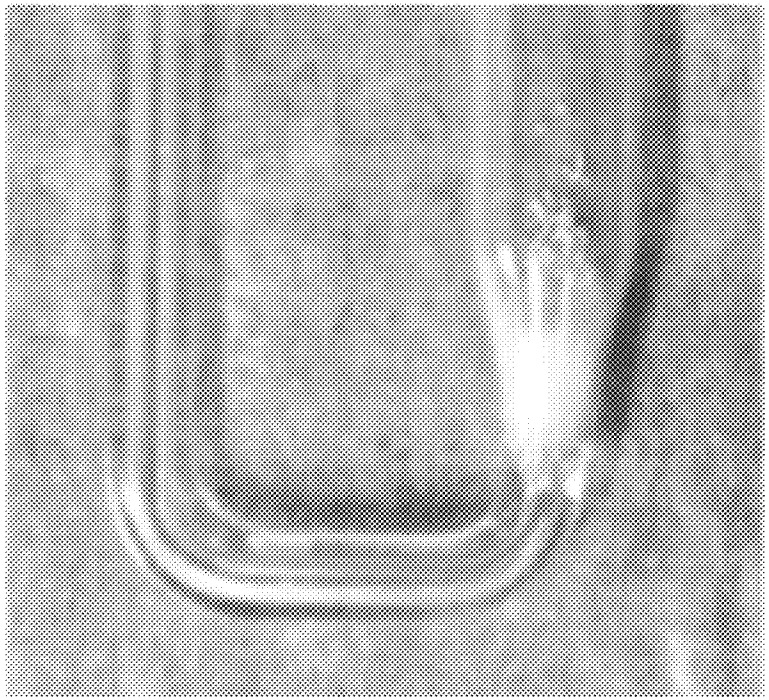
FIG. 1 is a photo showing a temperature programmed oxidation reactor following programmed heating of a test sample A including an organometallic combustion catalyst and soot, according to an embodiment.

FIG. 1 is a photo showing a temperature programmed oxidation reactor following programmed heating of a test sample A including an organometallic combustion catalyst and soot, according to an embodiment. FIG. 2 is a photo showing a temperature programmed oxidation reactor following programmed heating of a test sample B including a metal oxide combustion catalyst and soot, according to an embodiment.

The test sample A included an organometallic combustion catalyst including a positive oxidation state metal in a coordination complex with a ligand on soot. The positive oxidation state metal included cerium. Combustion occurred while a gas including 5% oxygen was supplied to the test sample through the narrow part of the combustion reactor. The test sample B included the same positive oxidation state metal as sample A, but as an oxide on soot at a similar molar ratio to sample A and supplied with the gas including 5% oxygen.

Comparing FIG. 1 to FIG. 2, one can see that the oxidation of carbon including the organometallic combustion catalyst was more complete than the oxidation of carbon including the metal oxide combustion catalyst. The region at the diameter change of the combustion reactor of FIG. 1 is white, which corresponds to the conversion of the organometallic catalyst to a corresponding metal oxide during substantially complete oxidation of the carbon particles. In contrast, the region at the diameter change of the combustion reactor of FIG. 2 is partially white, corresponding to the metal oxide, but also includes black, indicating incomplete oxidation of the carbon particles.

The image of FIG. 1 shows the amount of soot left in the reactor, after cooling, after an oxidation reaction of the soot ran from room temperature to 550° C. at 20° C./min ramp rate. Sample A was completely combusted, leaving white powder (metal oxide) behind. As shown in FIG. 2, sample B was partially combusted, leaving carbon black in the reactor.

Figure 3:
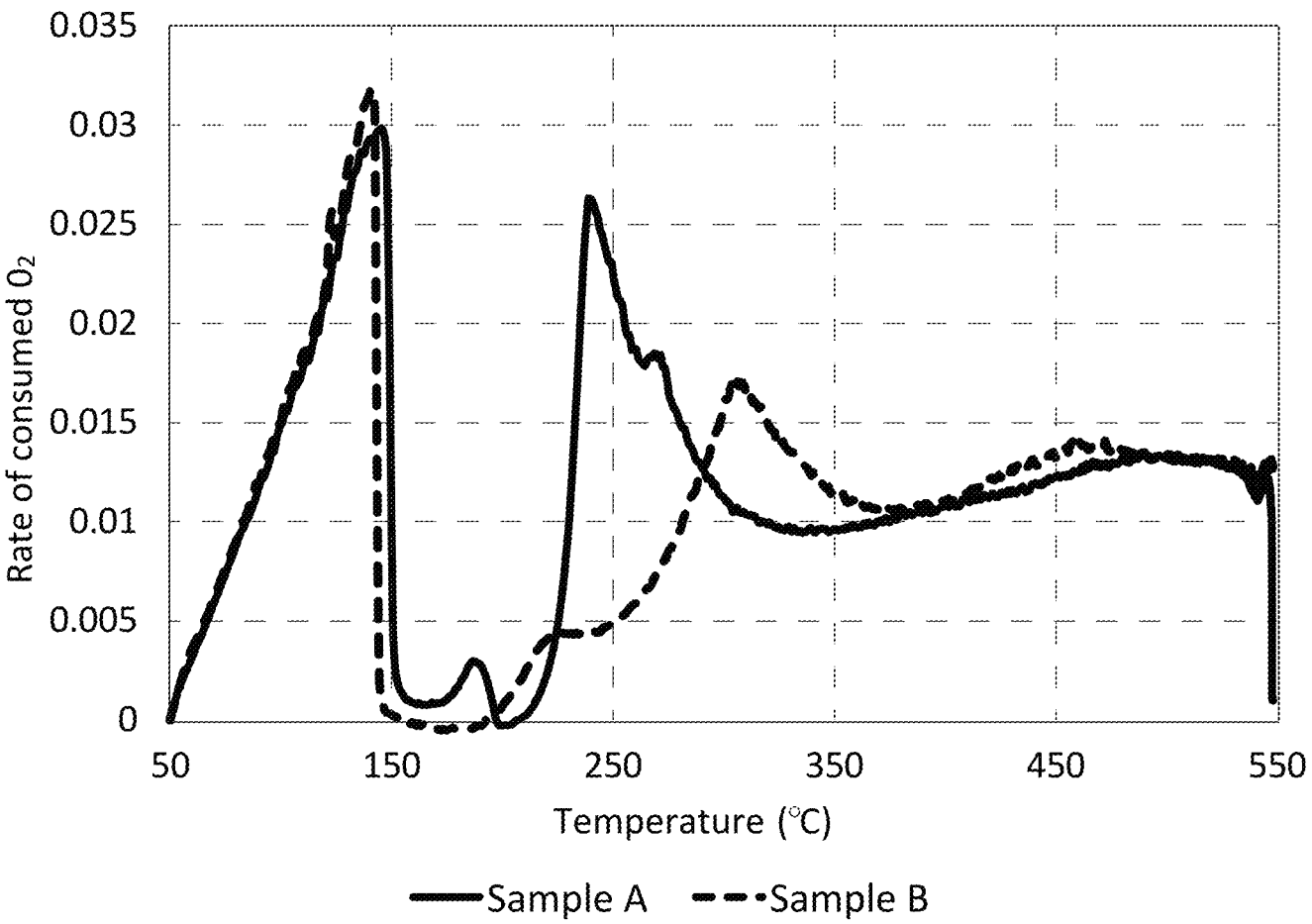
FIG. 3 is a graph showing an oxygen uptake performance comparison of the metal oxide combustion catalyst sample A of FIG. 1 with the organometallic combustion catalyst sample B of FIG. 2, according to an embodiment.

FIG. 3 is a graph showing an oxygen uptake performance comparison of the combustion catalyst sample A to the combustion catalyst sample B, according to an embodiment. As may be appreciated by inspection, both samples behaved similarly up to about 220° C., likely caused by oxygen adsorption onto the carbon particles. By about 240° C. the sample A showed a high rate of oxygen uptake, indicating combustion of the carbon under the influence of the organometallic combustion catalyst. In contrast, the maximum rate of oxygen uptake of the sample B occurred at a higher temperature of about 300° C., indicating that the metal oxide combustion catalyst required a higher temperature to catalyze combustion of the carbon. This suggests that a combustion reaction will begin earlier in a compression cycle of a Diesel engine burning fuel including the fuel-borne organometallic combustion catalyst of sample A compared to a Diesel engine burning fuel including the fuel-born metal oxide combustion catalyst of sample B.

One may further appreciate, by comparing the integrated areas under the curves corresponding to sample A and sample B, the more complete combustion achieved with sample A. The sample A exhibited higher total oxygen uptake than sample B, which corresponds well to the visual comparison of combustion products shown in FIGS. 1 and 2.

Table 1 illustrates a comparison of total oxygen consumption for sample A vs. sample B, which corresponds to the integrated areas.

TABLE 1

Oxygen Uptake with Fuel-Borne Catalysts

| SAMPLE | CONSUMED $O_2$ mmols/gram soot | CONSUMED $O_2$ mmols/gram metal |
|---|---|---|
| Sample A | 4.8882 | 427 |
| Sample B | 4.5779 | 235 |

Table 1 indicates that the organometallic catalyst provided more efficient catalysis than the corresponding metal oxide catalyst. Column 2 shows that the amount of consumed oxygen per gram of soot was greater for sample A than for sample B, meaning that the combustion of the fuel (in this case, carbon black) was more efficient in the sample using the organometallic catalyst compared to the sample using the metal oxide catalyst. Column 3 shows that the amount of metal in the catalyst necessary to achieve the completeness of combustion was superior in the sample A organometallic catalyst sample than in the sample B metal oxide catalyst. In other words, less catalyst is needed to achieve a desired catalytic effect.

The inventors contemplate two effects that may result in this behavior. First, it is believed that the organometallic catalyst facilitated better useful adsorption of oxygen and transport into the carbon particles. As may be seen in FIG. 3, both catalysts provided similar actual oxygen adsorption, but it appears that the organometallic catalyst of sample A caused the adsorbed oxygen to react, whereas it is apparent that the adsorbed oxygen in sample B was simply less efficient at causing reaction at a low temperature. Secondly, it is believed that the organometallic catalyst of sample A provided superior dehydrogenation of the carbon compared to the metal oxide catalyst of sample B.

Figure 4:
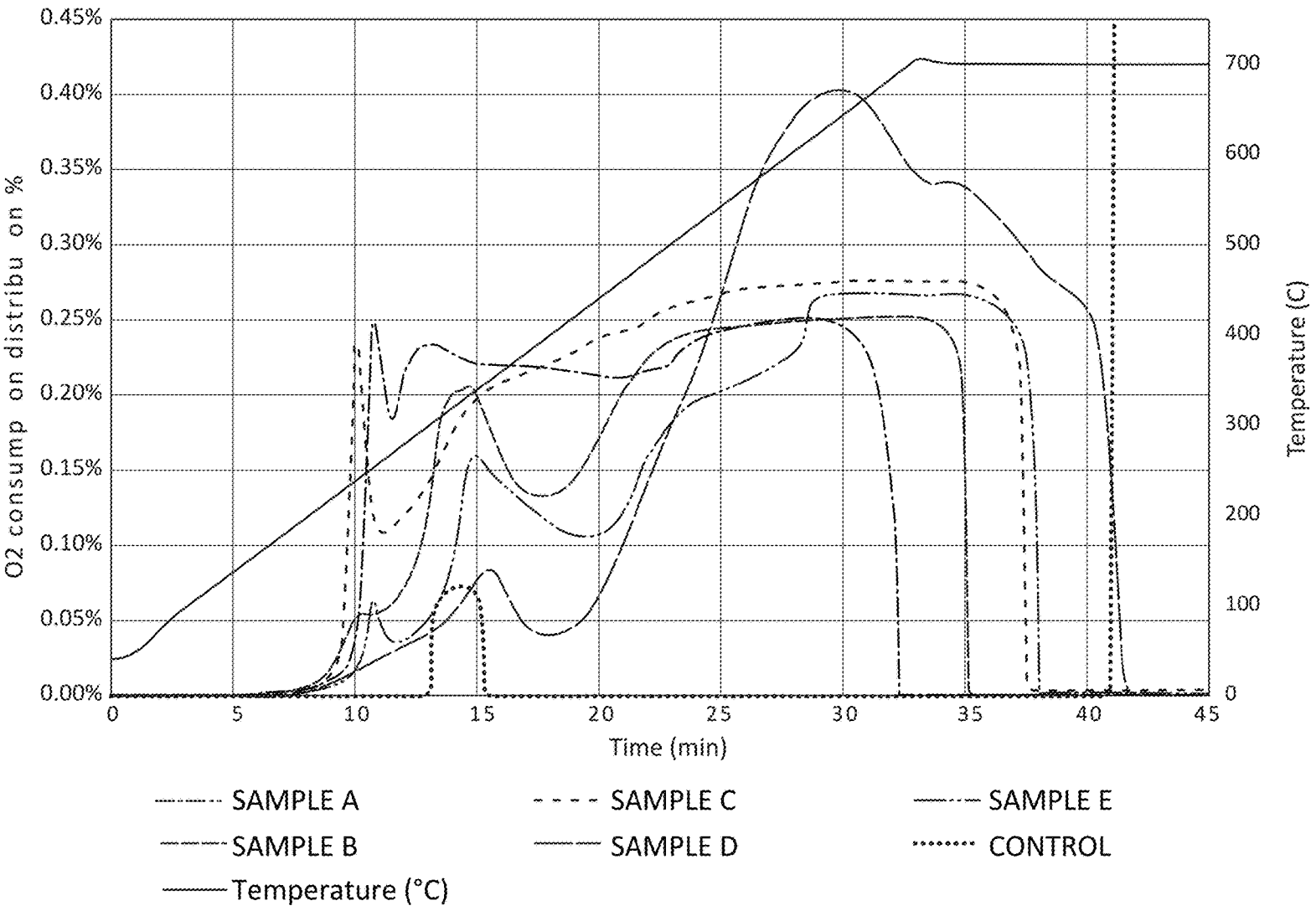
FIG. 4 is a graph showing an oxygen uptake distribution comparison of five different catalyst test samples, including samples A and B of FIGS. 1-3, and a control sample, according to an embodiment.

FIG. 4 is a graph showing the oxygen uptake performance, by percentage, of combustion catalyst samples A-E, according to an embodiment. Referring to FIG. 4, test sample A included an organometallic combustion catalyst including a positive oxidation state metal in a coordination complex with a ligand on soot, the metal being cerium. Test sample B included the same positive oxidation state metal as sample A, but as an oxide on soot.

Test sample C included a mixture of two organometallic catalysts on soot. The organometallic catalysts of sample C were a mixture of cerium-ligand and iron-ligand. Test sample D included an organometallic catalyst on soot. The organometallic catalyst of sample D was ferrocene. Test sample E included a mixture of two organometallic combustion catalysts on soot. The organometallic catalysts of sample E were cerium-ligand and a platinum-ligand. Also shown in FIG. 3 is a curve showing a control test sample consisting of carbon black only.

In the tests performed with samples A-E that produced the data shown in FIG. 3, each sample was heated in a reactor from room temperature to 700° C. at 20° C./min ramp rate. Once they reached 700° C. the samples were held at that temperature for a period exceeding ten minutes.

The graph of FIG. 3 tracks the percentage of available $O_2$ consumed as the temperature increased. One conclusion one may draw is that all combustion catalysts provided reduced-temperature oxidation of carbon black compared to the control experiment with no combustion catalyst. The various catalysts and mixtures thereof may be selected according to particular application environments.

According to an embodiment, a diesel fuel is provided, that includes a diesel fuel additive formulated according to the principles described with reference to previous embodiments.

The fuel may include the diesel fuel additive diluted in the fuel to provide a cetane number improver at a concentration in the fuel of between fifty and two thousand parts per million (50-2000 ppm) and the organometallic catalyst at a concentration in the fuel of between one and one-hundred parts per million (1-100 ppm). The fuel may include the diesel fuel additive diluted in the fuel to provide a lubricant at a concentration in the fuel of between fifty and four hundred parts per million (50-400 ppm) and may include a detergent at a concentration in the fuel of between fifty and four hundred parts per million (50-400 ppm).

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A diesel fuel additive, comprising:

one or more hydrocarbon solvents, predominantly including carbon numbers between C6 and C16, the one or more hydrocarbon solvents being at less than 65% concentration by weight in the diesel fuel additive as a whole;

a cetane number improver, soluble in the one or more hydrocarbon solvents, at 20% to 85% concentration by weight in the diesel fuel additive as a whole; and at least one organometallic combustion catalyst including a positive oxidation state metal ion in a coordination complex providing solubility in the one or more hydrocarbon solvents, the at least one organometallic combustion catalyst being at 0.1% to 30% total concentration by weight in the diesel fuel additive as a whole;

wherein organic components of the diesel fuel additive consist essentially of molecules having carbon numbers of C19 or less.

2. The diesel fuel additive of claim 1, wherein the one or more hydrocarbon solvents and the at least one organometallic combustion catalyst are collectively less than 70% concentration by weight in the diesel fuel additive as a whole.

3. The diesel fuel additive of claim 1, wherein at least 90% of organic molecules in the diesel fuel additive have carbon numbers of C6 to C16.

4. The diesel fuel additive of claim 1, wherein the one or more hydrocarbon solvents are at a concentration between 10% and 45% by weight in the diesel fuel additive as a whole.

5. The diesel fuel additive of claim 1, wherein the one or more hydrocarbon solvents includes a plurality of hydrocarbon solvents, the plurality of hydrocarbon solvents comprising:

hydrotreated heavy petroleum naphtha, predominantly having carbon numbers between C6 and C13, at 0.5% to 25% concentration by weight in the diesel fuel additive as a whole;

light aromatic petroleum solvent naphtha, having carbon numbers between C9 and C16, at a concentration between 1.5% and 40% by weight in the diesel fuel additive as a whole; and heavy aromatic petroleum solvent naphtha, having carbon numbers between C8 and C10, at a concentration between 2% and 25% by weight in the diesel fuel additive as a whole;

wherein the sum of the hydrotreated heavy petroleum naphtha, light aromatic petroleum solvent naphtha, and heavy aromatic petroleum solvent naphtha is less than 65% by weight in the diesel fuel additive as a whole.

6. The diesel fuel additive of claim 1, wherein the cetane number improver is at least 40% concentration by weight.

7. The diesel fuel additive of claim 1, wherein the cetane number improver includes at least one selected from the group consisting of a (—$NO_2$) nitro-substituted organic molecule having a carbon number between C6 and C19, a nitro-alkane, 2-ethylhexylnitrate, a nitro carbonate organic molecule having a carbon number between C6 and C19, and a peroxide organic molecule having a carbon number between C6 and C19.

8. The diesel fuel additive of claim 1, wherein the at least one organometallic combustion catalyst has a concentration of 1.3% to 17% by weight in the combustion catalyst as a whole.

9. The diesel fuel additive of claim 1,

The diesel fuel additive of claim 1, wherein the positive oxidation state metal ion includes at least one metal element selected from the group consisting of potassium (K), calcium (Ca), iron (Fe), cerium (Ce), and platinum (Pt); and wherein the positive oxidation state metal ion includes, in respective coordination complexes, two or more different positive oxidation state metal ions.

10. The diesel fuel additive of claim 9, wherein the two or more different positive oxidation state metal ions include cerium and iron.

11. The diesel fuel additive of claim 10, wherein the coordination complexes include a cerium and ligand complex at a concentration of 0.1% to 9% by weight and an iron and ligand complex at a concentration of 0.75% to 28% by weight, each expressed as concentration in the diesel fuel additive as a whole.

12. The diesel fuel additive of claim 9, wherein the organometallic combustion catalyst consists essentially of a cerium and ligand complex at a concentration in the diesel fuel additive as a whole of between 3% and 20% by weight.

13. The diesel fuel additive of claim 9, wherein the organometallic combustion catalysts consists essentially of an iron and ligand complex at a concentration in the diesel fuel additive as a whole of between 7.5% and 28% by weight.

14. The fuel additive of claim 1, further comprising:

a detergent soluble in the one or more hydrocarbon solvents.

15. The fuel additive of claim 1, further comprising a lubricant soluble in the one or more hydrocarbon solvents, the lubricant including an acid- or ester-functionalized aliphatic chain.

16. A fuel including the diesel fuel additive of claim 1.

17. The fuel of claim 16, wherein the diesel fuel additive is diluted in the fuel to provide:

the cetane number improver at a concentration in the fuel of between fifty and two thousand parts per million (50-2000 ppm); and the at least one organometallic combustion catalyst at a concentration in the fuel of between one and one-hundred parts per million (1-100 ppm).

18. The fuel of claim 17, wherein the diesel fuel additive of claim 1 further comprises a lubricant and a detergent, which when diluted in the fuel provide:

a lubricant at a concentration in the fuel of between fifty and four hundred parts per million (50-400 ppm); and a detergent at a concentration in the fuel of between fifty and four hundred parts per million (50-400 ppm).

* * * * *